US010001281B2

(12) United States Patent
Patel et al.

(10) Patent No.: US 10,001,281 B2
(45) Date of Patent: Jun. 19, 2018

(54) FUEL NOZZLE WITH DUAL-STAGED MAIN CIRCUIT

(71) Applicant: General Electric Company, Schenectady, NY (US)

(72) Inventors: Nayan Vinodbhai Patel, Liberty Township, OH (US); Duane Douglas Thomsen, Lebanon, OH (US)

(73) Assignee: General Electric Company, Schenectady, NY (US)

( * ) Notice: Subject to any disclaimer, the term of this patent is extended or adjusted under 35 U.S.C. 154(b) by 370 days.

(21) Appl. No.: 14/689,765

(22) Filed: Apr. 17, 2015

(65) Prior Publication Data

US 2016/0305327 A1 Oct. 20, 2016

(51) Int. Cl.

| | |
|---|---|
| ***F23R 3/28*** | (2006.01) |
| ***F23R 3/14*** | (2006.01) |
| ***F23R 3/34*** | (2006.01) |
| ***F23C 7/00*** | (2006.01) |
| ***F23R 3/36*** | (2006.01) |

(52) U.S. Cl.

CPC ..... *F23R 3/286* (2013.01); *F23C 7/004* (2013.01); *F23R 3/14* (2013.01); *F23R 3/343* (2013.01); *F23R 3/346* (2013.01); *F23R 3/36* (2013.01)

(58) Field of Classification Search

CPC .. F23C 7/004; F23R 3/14; F23R 3/286; F23R 3/343; F23R 3/36; F23R 3/346

See application file for complete search history.

(56) References Cited

U.S. PATENT DOCUMENTS

| | | | | |
|---|---|---|---|---|
| 6,381,964 | B1 * | 5/2002 | Pritchard, Jr. ..... | F23R 3/14 60/746 |
| 7,779,636 | B2 | 8/2010 | Buelow et al. | |
| 7,788,927 | B2 | 9/2010 | McMasters et al. | |
| 8,001,761 | B2 | 8/2011 | Myers, Jr. et al. | |
| 2002/0092302 | A1 * | 7/2002 | Johnson ..... | F23C 99/00 60/737 |

(Continued)

OTHER PUBLICATIONS

Benjamin, et. al., U.S. Appl. No. 61/920,002, filed Dec. 23, 2013.

(Continued)

*Primary Examiner* — Pascal M Bui Pho
*Assistant Examiner* — Kyle Thomas
(74) *Attorney, Agent, or Firm* — General Electric Company; Pamela Kachur

(57) ABSTRACT

A fuel nozzle apparatus for a gas turbine engine includes: an annular outer body extending parallel to a centerline axis and having an exterior surface, and having a ring of forward openings passing through the exterior surface, and a ring of aft openings passing through the exterior surface, the aft openings positioned axially aft of the forward openings; an annular main injection ring disposed inside the outer body and including: a forward main fuel gallery extending in a circumferential direction; an aft main fuel gallery extending in a circumferential direction; a ring of forward main fuel orifices communicating with the forward main fuel gallery and each aligned with one of the forward openings; a ring of aft main fuel orifices, communicating with the aft main fuel gallery and each aligned with one of the aft openings; and a pilot fuel injector disposed along the centerline axis.

6 Claims, 6 Drawing Sheets

(56) References Cited

U.S. PATENT DOCUMENTS

| | | | | |
|---|---|---|---|---|
| 2004/0025508 | A1* | 2/2004 | Calvez | F23R 3/14 60/746 |
| 2004/0148938 | A1* | 8/2004 | Mancini | F23K 5/18 60/740 |
| 2007/0028618 | A1 | 2/2007 | Hsiao et al. | |
| 2007/0028620 | A1* | 2/2007 | McMasters | F23R 3/286 60/748 |
| 2007/0271927 | A1* | 11/2007 | Myers | F02C 9/28 60/776 |
| 2009/0255262 | A1* | 10/2009 | McMasters | F23R 3/14 60/742 |
| 2011/0259976 | A1* | 10/2011 | Tyler | F23D 11/386 239/125 |
| 2012/0234013 | A1* | 9/2012 | Overman | F23R 3/343 60/772 |

OTHER PUBLICATIONS

Mook, et al., U.S. Appl. No. 61/920,018, filed Dec. 23, 2013.
U.S. Appl. No. 15/681,851, filed Aug. 21, 2017.
U.S. Appl. No. 15/681,918, filed Aug. 21, 2017.

* cited by examiner

FUEL NOZZLE WITH DUAL-STAGED MAIN CIRCUIT

BACKGROUND OF THE INVENTION

The present invention relates to gas turbine engine fuel nozzles and, more particularly, to main injection structures for gas turbine engine fuel nozzles.

Aircraft gas turbine engines include a combustor in which fuel is burned to input heat to the engine cycle. Typical combustors incorporate one or more fuel injectors whose function is to introduce liquid fuel into an air flow stream so that it can atomize and burn.

Staged combustors have been developed to operate with low pollution, high efficiency, low cost, high engine output, and good engine operability. In a staged combustor, the fuel nozzles of the combustor are operable to selectively inject fuel through two or more discrete stages, each stage being defined by individual fuel flowpaths within the fuel nozzle. For example, the fuel nozzle may include a pilot stage that operates continuously, and a main stage that only operates at higher engine power levels. The fuel flowrate may also be variable within each of the stages.

The main stage includes an annular main injection ring having a plurality of fuel injection ports which discharge fuel through a surrounding centerbody into a swirling mixer airstream. As engine operational requirements become stricter in terms of noise, emissions, and efficiency, there is a need to provide this type of fuel nozzle with greater operational flexibility and control.

BRIEF DESCRIPTION OF THE INVENTION

This need is addressed by the present invention, which provides a fuel nozzle incorporating a main injection ring having two axially-separated rings of main fuel orifices.

According to one aspect of the invention, a fuel nozzle apparatus for a gas turbine engine includes: an annular outer body extending parallel to a centerline axis and having an exterior surface extending between forward and aft ends, and having a ring of forward openings passing through the exterior surface, and a ring of aft openings passing through the exterior surface, the aft openings positioned axially aft of the forward openings; an annular main injection ring disposed inside the outer body and including: a forward main fuel gallery extending in a circumferential direction; an aft main fuel gallery extending in a circumferential direction; a ring of forward main fuel orifices, each forward main fuel orifice communicating with the forward main fuel gallery and aligned with one of the forward openings; a ring of aft main fuel orifices, each aft main fuel orifice communicating with the aft main fuel gallery and aligned with one of the aft openings; and a pilot fuel injector disposed along the centerline axis.

According to another aspect of the invention, the aft openings are laterally offset from the forward openings.

According to another aspect of the invention, different numbers of forward and aft openings and corresponding main fuel orifices are provided.

According to another aspect of the invention, the pilot fuel injector includes a pilot primary fuel injector and a pilot secondary fuel injector.

According to another aspect of the invention, a suspension structure connects the main injection ring to the outer body, the suspension structure configured to substantially rigidly locate the position of the main ring in axial and lateral directions while permitting controlled deflection in a radial direction.

According to another aspect of the invention, the suspension structure includes: an annular flange extending radially inward from the outer body aft of the openings; an annular inner arm extending forward from the flange in a generally axial direction, and passing radially inboard of the main injection ring; an annular outer arm extending axially forward from the main injection ring; and a U-bend interconnecting the inner and outer arms at a location axially forward of the main injection ring.

According to another aspect of the invention, the main injection ring includes an annular array of fuel posts extending radially outward therefrom; a baffle extends forward from the flange in a generally axial direction and passes radially outboard of the main injection ring; and the baffle includes an opening through which the fuel post passes.

According to another aspect of the invention, a forward end of the baffle is connected to the outer body forward of the openings.

According to another aspect of the invention, a radial gap is present between the fuel posts and the outer body; each fuel post includes a perimeter wall defining a cylindrical lateral surface and a bore defining a radially-outward-facing floor recessed radially inward from a distal end surface of the perimeter wall; and a generally tubular slip seal is received in the bore of each fuel post and spans the radial gap.

According to another aspect of the invention, each slip seal is fixed in one of the openings of the outer body and is received in the corresponding bore of a fuel post with a slip fit.

According to another aspect of the invention, the apparatus further includes: an annular venturi including a throat of minimum diameter disposed inside the main injection ring, surrounding the pilot fuel injector; an annular splitter disposed inside the venturi; an array of outer swirl vanes extending between the venturi and the splitter; and an array of inner swirl vanes extending between the splitter and the pilot fuel injector.

According to another aspect of the invention, the apparatus further includes: a fuel system operable to supply a flow of liquid fuel at varying flowrates; a pilot fuel conduit coupled between the fuel system and the pilot fuel injector; a forward main fuel conduit coupled between the fuel system and the forward main fuel gallery; and an aft main fuel conduit coupled between the fuel system and the aft main fuel gallery.

According to another aspect of the invention, the fuel system includes a fuel control operable to provide an independently-controllable flow to each fuel conduit.

According to another aspect of the invention, the fuel system includes a fuel control operable to provide an independently-controllable flow to some of the fuel conduits not including the aft main fuel conduit, and a staging valve which interconnects one of the independently-controlled conduits to the aft main fuel conduit.

BRIEF DESCRIPTION OF THE DRAWINGS

The invention may be best understood by reference to the following description, taken in conjunction with the accompanying drawing figures in which.

DETAILED DESCRIPTION OF THE INVENTION

Figure 1:
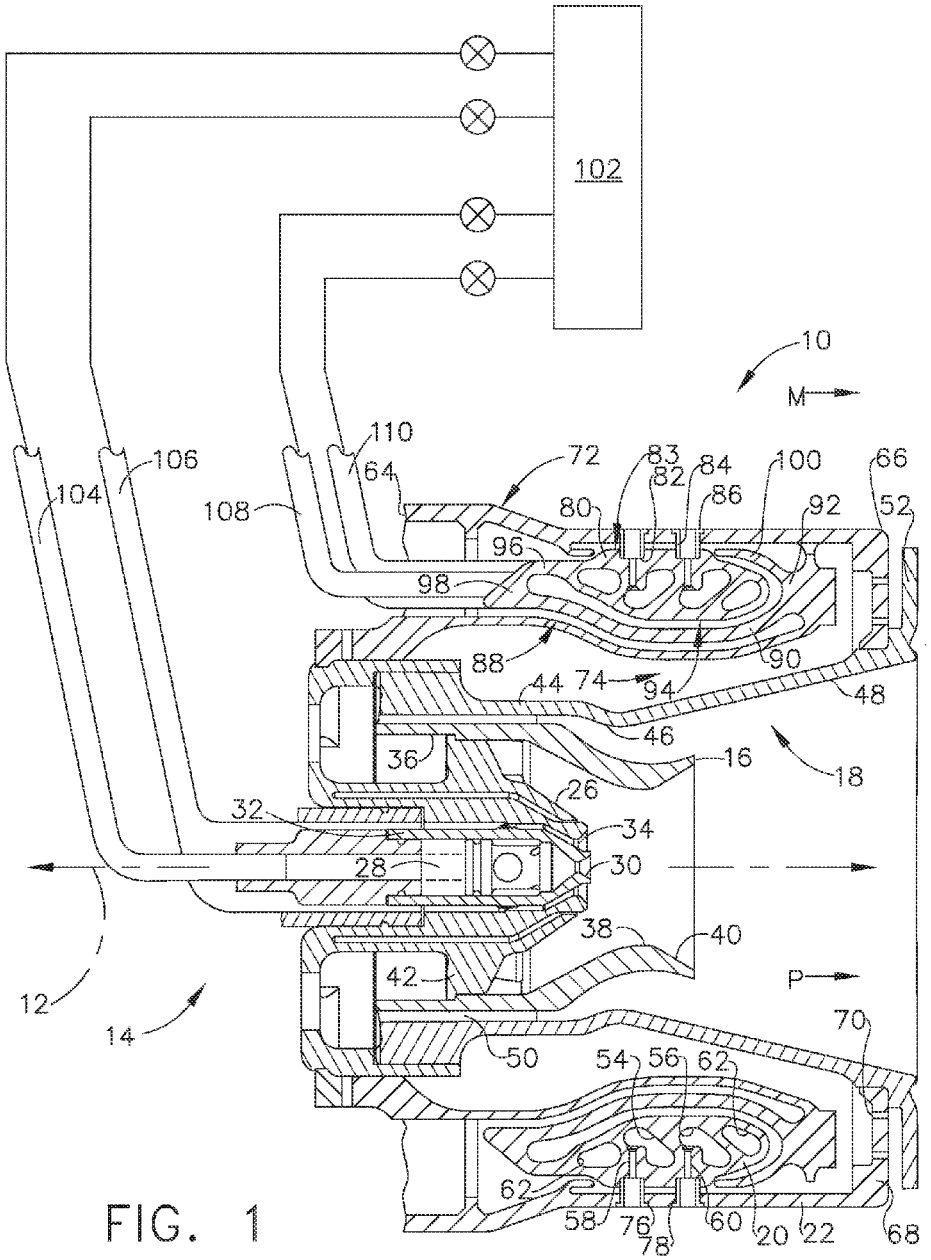
FIG. 1 is a schematic cross-sectional view of a gas turbine engine fuel nozzle constructed according to an aspect of the present invention.

Referring to the drawings wherein identical reference numerals denote the same elements throughout the various views, FIG. 1 depicts an exemplary fuel nozzle 10 of a type configured to inject liquid hydrocarbon fuel into an airflow stream of a gas turbine engine combustor (not shown). The fuel nozzle 10 is of a "staged" type meaning it is operable to selectively inject fuel through two or more discrete stages or circuits, each stage or circuit being defined by individual fuel flowpaths within the fuel nozzle 10. The fuel flowrate may also be variable within each of the stages.

For purposes of description, reference will be made to a centerline axis 12 of the fuel nozzle 10 which is generally parallel to a centerline axis of the engine (not shown) in which the fuel nozzle 10 would be used. Starting from the centerline axis 12 and proceeding radially outward, the major components of the illustrated fuel nozzle 10 are: a pilot fuel injector 14, a splitter 16, a venturi 18, a main injection ring 20, and an outer body 22. Each of these structures will be described in detail.

The pilot fuel injector 14 is disposed at an upstream end of the fuel nozzle 10, aligned with the centerline axis 12. The illustrated pilot fuel injector 14 includes a generally cylindrical, axially-elongated, pilot centerbody 26. A first metering plug 28 is disposed within the pilot centerbody 26. It communicates with a pressurized fuel supply, described in more detail below, and communicates with a pilot primary discharge orifice 30 at a downstream end of the pilot centerbody 26. As used herein, the pilot primary discharge orifice 30 is the injection point of a "pilot primary fuel injector", which represents a pilot primary stage or circuit "PP" of the fuel nozzle 10. A second metering plug 32 surrounds the first metering plug 28. It also communicates with a pressurized fuel supply, described in more detail below, and terminates at a pilot secondary discharge orifice 34 at the downstream end of the pilot centerbody 26. As used herein, the pilot secondary discharge orifice 34 is the discharge point of a "pilot secondary fuel injector", which represents a pilot secondary stage or circuit "PS" of the fuel nozzle 10.

The annular splitter 16 surrounds the pilot fuel injector 14. It includes, in axial sequence: a generally cylindrical upstream section 36, a throat 38 of minimum diameter, and a downstream diverging section 40.

An inner air swirler comprises a radial array of inner swirl vanes 42 which extend between the pilot fuel injector 14 and the upstream section 36 of the splitter 16. The inner swirl vanes 42 are shaped and oriented to induce a swirl into air flow passing through the inner air swirler.

The annular venturi 18 surrounds the splitter 16. It includes, in axial sequence: a generally cylindrical upstream section 44, a throat 46 of minimum diameter, and a downstream diverging section 48.

A radial array of outer swirl vanes 50 defining an outer air swirler extends between the splitter 16 and the venturi 18. The outer swirl vanes 50, splitter 16, and inner swirl vanes 42 physically support the pilot fuel injector 14. The outer swirl vanes 50 are shaped and oriented to induce a swirl into air flow passing through the outer air swirler.

The bore of the venturi 18 defines a flowpath for a pilot air flow, generally designated "P", through the fuel nozzle 10. A heat shield 52 in the form of an annular, radially-extending plate may be disposed at an aft end of the diverging section 48. A thermal barrier coating (TBC) (not shown) of a known type may be applied on the surface of the heat shield 52 and/or the diverging section 48.

The main injection ring 20 which is annular in form surrounds the venturi 18. The main injection ring 20 is connected to the venturi 18 and to the outer body 22 by a suspension structure which is described in more detail below.

The main injection ring 20 includes a forward main fuel gallery 54 and an aft main fuel gallery 56. A ring of forward main fuel orifices 58 formed in the main injection ring 20 communicate with the forward main fuel gallery 54, and a ring of aft main fuel orifices 60 formed in the main injection ring 20 communicate with the aft main fuel gallery 56. The forward main fuel orifices 58 represent a forward main stage or circuit "FM" of the fuel nozzle 10, and the aft main fuel orifices 60 represent an aft main stage or circuit "AM" of the fuel nozzle 10.

During engine operation, fuel is discharged through the forward and aft main fuel orifices 58 and 60. Running through the main injection ring 20 closely adjacent to the forward and aft main fuel galleries 54, 56 are one or more pilot fuel galleries 62. During engine operation, fuel constantly circulates through the pilot fuel galleries 62 to cool the main injection ring 20 and prevent coking of the main fuel galleries 54, 56 and the main orifices 58, 60.

The annular outer body 22 has forward and aft ends 64, 66. It surrounds the main injection ring 20, venturi 18, and pilot fuel injector 14, and defines the outer extent of the fuel nozzle 10. The aft end 66 may include an annular, radially-extending baffle 68 incorporating cooling holes 70 directed at the heat shield 52. Extending between the forward and aft ends 64, 66 is a generally cylindrical exterior surface 72 which in operation is exposed to a mixer airflow, generally designated "M." The outer body 22 defines a secondary flowpath 74, in cooperation with the venturi 18. Air passing through this secondary flowpath 74 is discharged through the cooling holes 70.

The outer body 22 includes a ring annular array of forward openings 76 passing through the exterior surface 72, and a ring of aft openings 78 passing through the exterior surface 72, axially downstream of the forward openings 76. Each of the forward main fuel orifices 58 is aligned with one of the forward openings 76, and each of the aft main fuel orifices 60 is aligned with one of the aft openings 78.

Figure 2:
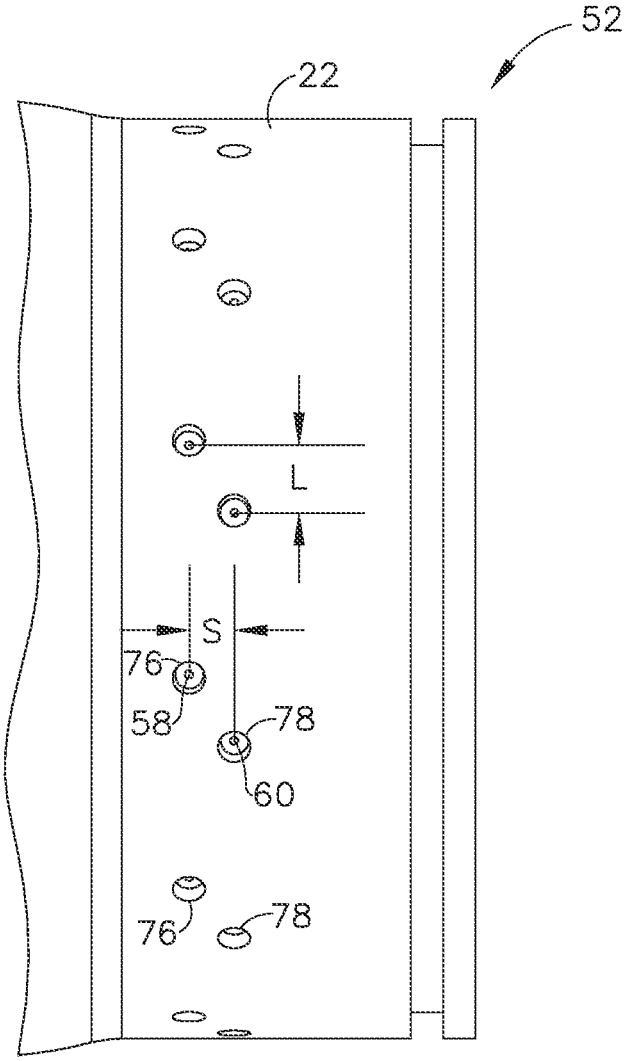
FIG. 2 is a side elevational view of a portion of the fuel nozzle of FIG. 1.

As seen in FIG. 2, the aft openings 78 are positioned axially downstream of the forward openings 76 by an axial spacing "S". Optionally, the aft openings 78 may be offset from the forward openings 76, or "clocked", by a lateral spacing "L". This has a technical effect and benefits described in more detail below. An equal number of forward and aft openings 76, 78 (and corresponding orifices 58, 60) may be provided, or optionally, different numbers may be used.

The main injection ring 20 includes a plurality of locally raised structures with increased thickness called fuel posts 80 extending radially outward therefrom. The fuel posts 80 (FIG. 1) include circular bores formed therein, defining a floor 82 recessed from a distal end face 83, which is radially spaced-away from the outer body 22 by a small radial gap. The main fuel orifices 58, 60 pass through the fuel posts 80, exiting through the floor 82.

Slip seals 84 span the gap between the fuel post 80 and the outer body 22. In the illustrated example the slip seal 84 is a small cylindrical tube with a radially-extending flange 86. The flange 86 is received in counter-bores in the openings 76, 78. The slip seals 84 are fixed relative to the outer body 22. This may be accomplished, for example, by a bonding method such as welding or brazing.

The slip seals 84 are received in the bores within fuel posts 80 with a sliding fit, i.e. with a small diametrical clearance. In operation, the main injection ring 20 can move relative to the outer body 22 solely in a radial direction, and remains engaged with the slip seals 84 at all times.

The main injection ring 20 is attached to the outer body 36 by a suspension structure 88. The suspension structure 88 includes an annular inner arm 90 extending forward from a flange 92 (which is connected to the outer body 22) in a generally axial direction. The inner arm 90 passes radially inboard of the main injection ring 20. In section view the inner arm 90 is curved convex-radially inward, and is spaced-away from and generally parallels the convex curvature of an inner surface 94 of the main injection ring 20. An annular outer arm 96 extends axially forward from the main injection ring 20. A U-bend 98 interconnects the inner and outer arms 90 and 94 at a location axially forward of the main injection ring 20. A baffle 100 extends forward from the flange 92 in a generally axial direction. The baffle 100 passes radially outboard of the main injection ring 20, between the main injection ring 20 and the outer body 22. In section view the baffle 100 is curved convex-radially outward, and is spaced-away from and generally parallels the convex curvature of an outer surface of the main injection ring 20. The baffle 100 includes openings through which the fuel posts 80 pass, and a forward end of the baffle is connected to the outer body 22 forward of those openings.

The suspension structure 88 is effective to substantially rigidly locate the position of the main injection ring 20 in axial and tangential (or lateral) directions while permitting controlled deflection in a radial direction. This is accomplished by the size, shape, and orientation of the elements of the suspension structure. In particular, the inner and outer arms 90, 96 and the U-bend 98 are configured to act as a spring element in the radial direction. In effect, the main injection ring 20 substantially has one degree of freedom of movement ("1-DOF").

During engine operation, the outer body 22 is exposed to a flow of high-temperature air and therefore experiences significant thermal expansion and contraction, while the main injection ring 20 is constantly cooled by a flow of liquid fuel and remains relative stable. The effect of the suspension structure 88 is to permit thermal growth of the outer body 22 relative to the main injection ring 20.

It is noted that the numerous variations are possible in the configuration of the main injection ring 20 and the fuel posts 80. The technical effects of the present invention do not depend on the suspension structure or the particular type of fuel posts. For example, FIGS. 6-11 illustrate some alternative fuel post configurations.

Figure 6:
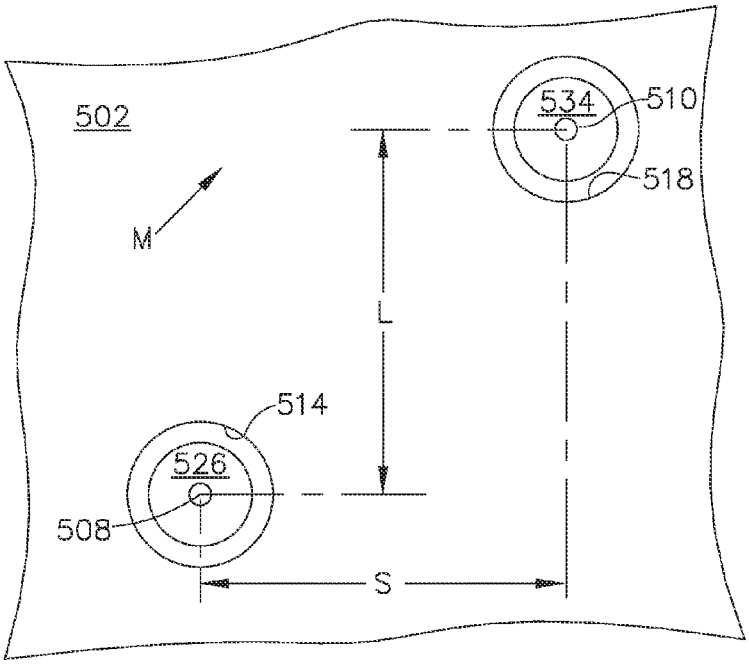
FIG. 6 is a top plan view of an alternative main fuel injection structure.
Figure 7:
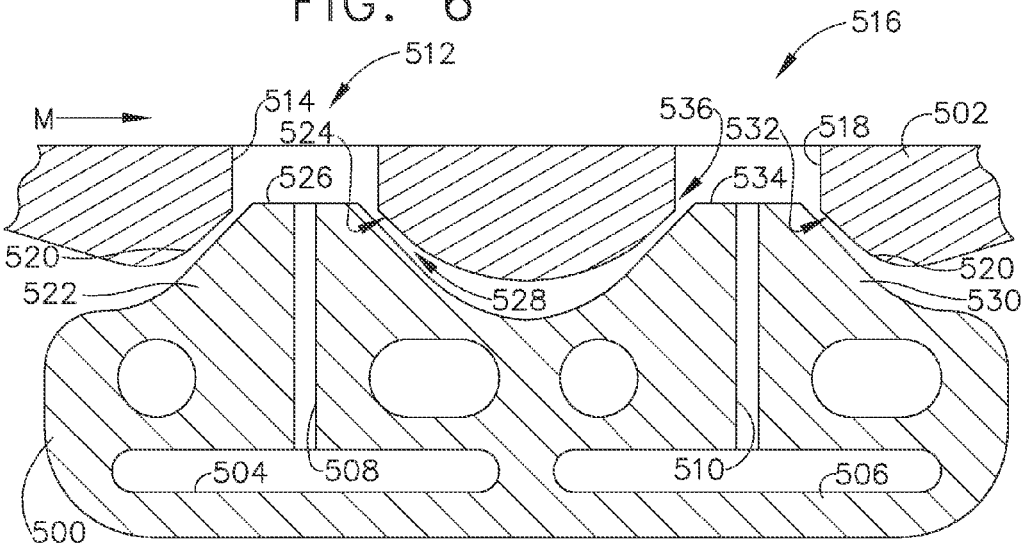
FIG. 7 is a sectional view of the fuel injection structure shown in FIG. 6.

FIGS. 6 and 7 illustrate an alternative main injection ring 500 and outer body 502, which may be substituted for the main injection ring 20 and outer body 22 described above.

The main injection ring 500 includes a forward main fuel gallery 504 and an aft main fuel gallery 506. A ring of forward main fuel orifices 508 formed in the main injection ring 500 communicate with the forward main fuel gallery 504, and a ring of aft main fuel orifices 510 formed in the main injection ring 500 communicate with the aft main fuel gallery 506. The forward main fuel orifices 508 represent a forward main stage or circuit "FM", and the aft main fuel orifices 510 represent an aft main stage or circuit "AM".

The outer body 502 includes an annular array of recesses referred to as forward spray wells 512. Each of the forward spray wells 512 is defined by a forward opening 514 in the outer body 502 in cooperation with the main injection ring 500. Each of the forward main fuel orifices 508 is aligned with one of the forward spray wells 512. The outer body 502 also includes an annular array of recesses referred to as aft spray wells 516. Each of the aft spray wells 516 is defined by an aft opening 518 in the outer body 502 in cooperation with the main injection ring 500. Each of the aft main fuel orifices 510 is aligned with one of the aft spray wells 516.

The main fuel orifices 508 and 510, and corresponding spray wells 512, 516 may be configured to provide a controlled secondary purge air path and an air assist at the main fuel orifices 508, 510. The openings 514, 518 in the outer body 502 are generally cylindrical and oriented in a radial direction. Each opening 514, 518 communicates with a conical well inlet 520 formed in the wall of the outer body 502. The local wall thickness of the outer body 502 adjacent the openings 514, 518 may be increased to provide thickness to define the well inlets 520.

The main injection ring 500 includes a plurality of raised forward fuel posts 522 extending radially outward therefrom. The forward fuel posts 522 are frustoconical in shape and include a conical lateral surface 524 and a planar, radially-facing outer surface 526. Each forward fuel post 522 is aligned with one of the forward openings 514. Together, the forward opening 514 and the associated forward fuel post 522 define one of the forward spray wells 512. The forward fuel post 522 is positioned to define an annular gap 528 in cooperation with the associated conical well inlet 520. One of the forward main fuel orifices 508 passes through each of the forward fuel posts 522, exiting through the outer surface 526.

The main injection ring 500 also includes a plurality of raised aft fuel posts 530 positioned axially downstream of the forward openings fuel posts by an axial spacing "S". The aft fuel posts 530 are frustoconical in shape and include a conical lateral surface 532 and a planar, radially-facing outer surface 534. Each aft fuel post 530 is aligned with one of the aft openings 518. Together, the aft opening 518 and the associated aft fuel post 530 define one of the aft spray wells 516. The aft fuel post 530 is positioned to define an annular gap 536 in cooperation with the associated conical well inlet 520. One of the aft main fuel orifices 510 passes through each of the aft fuel posts 530, exiting through the outer surface 534.

These small controlled gaps 528, 536 around the fuel posts 522, 530 respectively serve two purposes. First, the narrow passages permit minimal purge air to flow through to protect the internal tip space from fuel ingress. Second, the air flow exiting the gaps 528 provides an air-assist to facilitate penetration of fuel flowing from the main fuel orifices 508, 510 through the spray wells 512, 516 and into the local, high velocity mixer airstream M.

Figure 8:
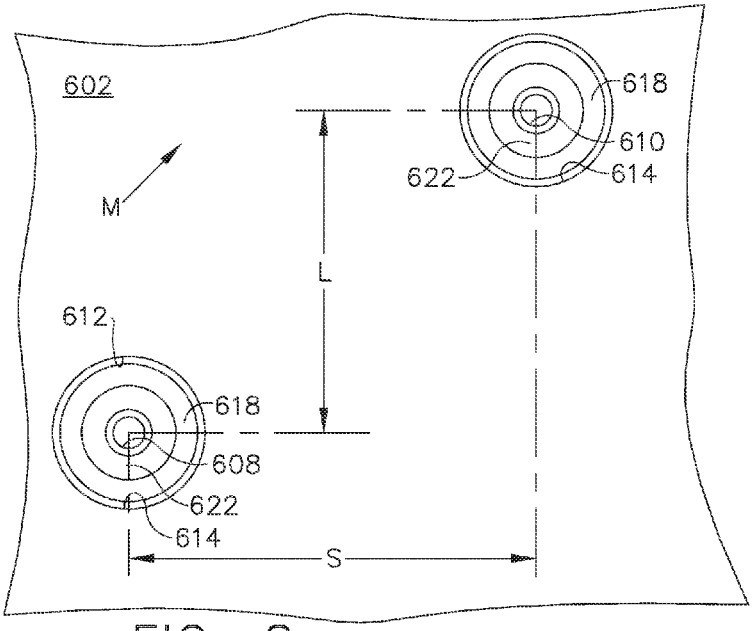
FIG. 8 is a top plan view of an alternative main fuel injection structure.
Figure 9:
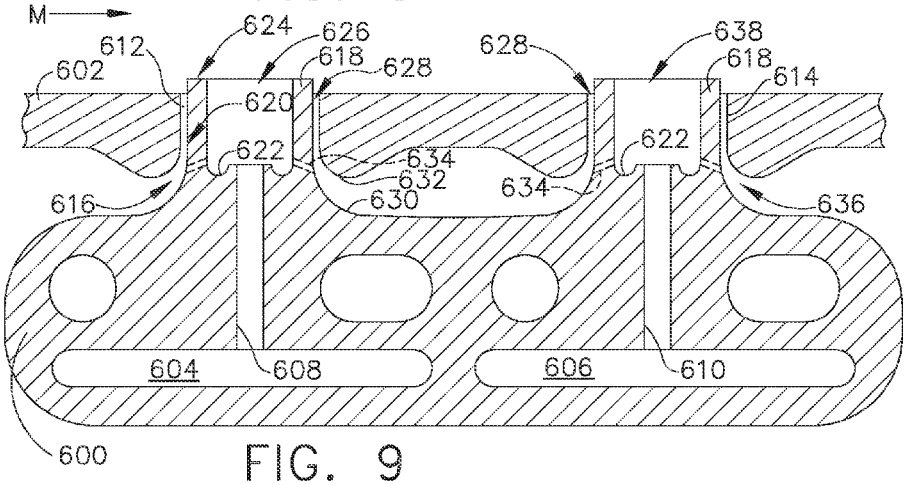
FIG. 9 is a sectional view of the fuel injection structure shown in FIG. 8.

FIGS. 8 and 9 illustrate an alternative main injection ring 600 and outer body 602, which may be substituted for the main injection ring 20 and outer body 22 described above.

The main injection ring 600 includes a forward main fuel gallery 604 and an aft main fuel gallery 606. A ring of forward main fuel orifices 608 formed in the main injection ring 600 communicate with the forward main fuel gallery 604, and a ring of aft main fuel orifices 610 formed in the main injection ring 600 communicate with the aft main fuel gallery 606. The forward main fuel orifices 608 represent a forward main stage or circuit "FM" and the aft main fuel orifices 610 represent an aft main stage or circuit "AM".

The outer body 602 includes an annular array of forward openings 612 which are generally cylindrical and oriented in a radial direction, and an annular array of aft openings 614 which are generally cylindrical and oriented in a radial direction.

The main injection ring 600 includes a plurality of raised forward fuel posts 616 extending radially outward therefrom. The forward fuel posts 616 include a perimeter wall 618 defining a cylindrical lateral surface 620. A radially-facing floor 622 is recessed from a distal end surface 624 of the perimeter wall 618, and in combination with the perimeter wall 618, defines a forward spray well 626. Each of the forward main fuel orifices 608 passes through one of the forward fuel posts 616, exiting through the floor 622 of the forward fuel post 616. Each forward fuel post 616 is aligned with one of the forward openings 612 and is positioned to define an annular gap 628 in cooperation with the associated forward opening 612. These small controlled gaps 628 around the forward fuel posts 616 permit minimal purge air to flow through to protect internal tip space or void from fuel ingress. The base 630 of the forward fuel post 616 may be configured with an annular concave fillet, and the wall of the outer body 602 may include an annular convex-curved fillet 632 at the forward opening 612. By providing smooth turning and area reduction of the inlet passage this configuration promotes even distribution and maximum attainable velocity of purge airflow through the annular gap 610.

One or more small-diameter assist ports 634 may be formed through the perimeter wall 618 of each forward fuel post 616 near its intersection with the floor 622. Air flow passing through the assist ports 634 provides an air-assist to facilitate penetration of fuel flowing from the forward main fuel orifices 608 through the forward spray wells 626 and into the local, high velocity mixer airstream M.

The main injection ring 600 includes a plurality of raised aft fuel posts 636 positioned axially downstream of the forward fuel posts 616 by an axial spacing "S". The aft fuel posts 636 are identical in construction and function to the forward fuel posts 616 and include a perimeter wall 618 and a radially facing floor 622 that cooperatively define an aft spray well 638. Each of the aft main fuel orifices 610 passes through one of the aft fuel posts 636. Each aft fuel post 636 is aligned with one of the aft openings 614 and is positioned to define an annular gap 628 in cooperation with the associated aft opening 614.

Figure 10:
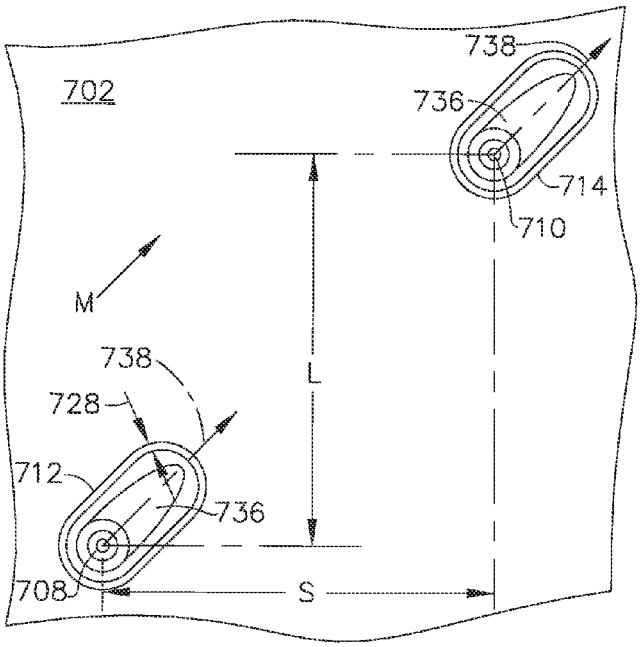
FIG. 10 is a top plan view of an alternative main fuel injection structure.
Figure 11:
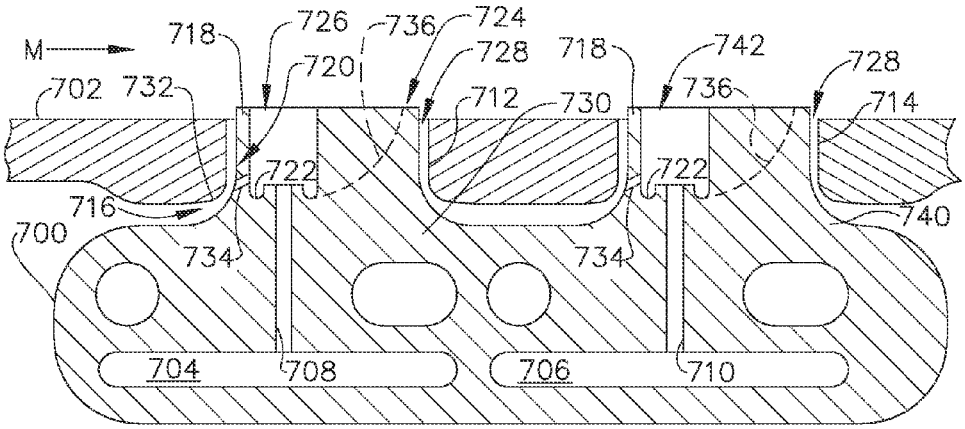
FIG. 11 is a sectional view of the fuel injection structure shown in FIG. 8.

FIGS. 10 and 11 illustrate an alternative main injection ring 700 and outer body 702, which may be substituted for the main injection ring 20 and outer body 22 described above.

The main injection ring 700 includes a forward main fuel gallery 704 and an aft main fuel gallery 706. A ring of forward main fuel orifices 708 formed in the main injection ring 700 communicate with the forward main fuel gallery 704, and a ring of aft main fuel orifices 710 formed in the main injection ring 700 communicate with the aft main fuel gallery 706. The forward main fuel orifices 708 represent a forward main stage or circuit "FM" and the aft main fuel orifices 710 represent an aft main stage or circuit "AM".

The outer body 702 includes an annular array of forward openings 712 and an annular array of aft openings 714, both of which are generally elongated in plan view. They may be oval, elliptical, or another elongated shape. In the specific example illustrated they are "racetrack-shaped". As used herein the term "racetrack-shaped" means a shape including two straight parallel sides connected by semi-circular ends.

The main injection ring 700 includes a plurality of raised forward fuel posts 716 extending radially outward therefrom. Each forward fuel post 716 includes a perimeter wall 718 defining a lateral surface 720. In plan view the forward fuel posts 716 are elongated and may be, for example, oval, elliptical, or racetrack-shaped as illustrated. A circular bore is formed in the forward fuel post 716, defining a floor 722 recessed from a distal end surface 724 of the perimeter wall 718, and in combination with the perimeter wall 718, defines a forward spray well 726. Each of the forward main fuel orifices 708 passes through one of the forward fuel posts 716, exiting through the floor 722 of the forward fuel post 726. Each forward fuel post 716 is aligned with one of the forward openings 712 and is positioned to define a perimeter gap 728 in cooperation with the associated forward opening 712. These small controlled gaps 728 around the forward fuel posts 716 permit minimal purge air to flow through to protect internal tip space from fuel ingress. The base 730 of the forward fuel post 716 may be configured with a concave fillet about its periphery, and the wall of the outer body 702 may include a thickened portion 732 which may be shaped into a convex-curved fillet at the forward opening 712. by providing smooth turning and area reduction of the inlet passage this configuration promotes even distribution and high velocity of purge airflow through the perimeter gap 728.

One or more small-diameter assist ports 734 may be formed through the perimeter wall 718 of each forward fuel post 716 near its intersection with the floor 722. Air flow passing through the assist ports 734 provides an air-assist to facilitate penetration of fuel flowing from the forward main fuel orifices 708 through the forward spray wells 726 and into the local, high velocity mixer airstream M.

The elongated shape of the forward fuel posts 716 provides surface area so that the distal end surface 724 of one or more of the forward fuel posts 716 can be configured to incorporate a ramp-shaped "scarf." The scarfs can be arranged to generate local static pressure differences between adjacent forward main fuel orifices 708. These local static pressure differences between adjacent forward main fuel orifices 708 may be used to purge stagnant main fuel from the main injection ring 700 during periods of pilot-only operation as to avoid main circuit coking.

When viewed in cross-section as seen in FIG. 11, the scarf 736 has its greatest or maximum radial depth (measured relative to the distal end surface 724) at its interface with the associated forward spray well 726 and ramps or tapers outward in radial height, joining the distal end surface 724 at some distance away from the forward spray well 726. In plan view, as seen in FIG. 10, the scarf 736 extends away from the forward main fuel orifice 708 along a line 738 parallel to the distal end surface 724 and tapers in lateral width to a minimum width at its distal end. The direction that the line 738 extends defines the orientation of the scarf 736. The scarf 736 shown in FIG. 10 is referred to as a "downstream" scarf, as it is parallel to a streamline of the rotating or swirling mixer airflow M and has its distal end located downstream from the associated main fuel orifice 708 relative to the mixer airflow M.

The presence or absence of the scarf 736 and orientation of the scarf 736 determines the static air pressure present at the associated forward main fuel orifice 708 during engine operation. The mixer airflow M exhibits "swirl," that is, its velocity has both axial and tangential components relative to the centerline axis 12. To achieve the purge function mentioned above, the forward spray wells 726 may be arranged such that different ones of the forward main fuel orifices 708 are exposed to different static pressures during engine operation. For example, each of the forward main fuel orifices 708 not associated with a scarf 726 would be exposed to the generally prevailing static pressure in the mixer airflow M. For purposes of description these are referred to herein as "neutral pressure ports." Each of the forward main fuel orifices 708 associated with a "downstream" scarf 736 as seen in FIG. 10 would be exposed to reduced static pressure relative to the prevailing static pressure in the mixer airflow M. For purposes of description these are referred to herein as "low pressure ports." While not shown, it is also possible that one or more scarfs 736 could be oriented opposite to the orientation of the downstream scarfs 736. These would be "upstream scarfs" and the associated main forward main fuel orifices 736 would be exposed to increased static pressure relative to the prevailing static pressure in the mixer airflow M. For purposes of description these are referred to herein as "high pressure ports."

The forward main fuel orifices 708 and scarfs 736 may be arranged in any configuration that will generate a pressure differential effective to drive a purging function. For example, positive pressure ports could alternate with neutral pressure ports, or positive pressure ports could alternate with negative pressure ports.

The main injection ring 700 also includes a plurality of raised aft fuel posts 740 positioned axially downstream of the forward fuel posts 716 by an axial spacing "S". The aft fuel posts 740 are identical in construction and function to the forward fuel posts 716 and include a perimeter wall 718 and a radially facing floor 722 that cooperatively define an aft spray well 742. Each of the aft main fuel orifices 710 passes through one of the aft fuel posts 740. Each aft fuel post 740 is aligned with one of the aft openings 714 and is positioned to define an annular gap 728 in cooperation with the associated aft opening 714. Each aft fuel post 740 may incorporate a scarf 736 as described above and these scarfs may be arranged as described above for the forward fuel posts 716.

The fuel nozzle 10 and its constituent components may be constructed from one or more metallic alloys. Nonlimiting examples of suitable alloys include nickel and cobalt-based alloys.

All or part of the fuel nozzle 10 or portions thereof may be part of a single unitary, one-piece, or monolithic component, and may be manufactured using a manufacturing process which involves layer-by-layer construction or additive fabrication (as opposed to material removal as with conventional machining processes). Such processes may be referred to as "rapid manufacturing processes" and/or "additive manufacturing processes," with the term "additive manufacturing process" being term herein to refer generally to such processes. Additive manufacturing processes include, but are not limited to: Direct Metal Laser Melting (DMLM), Laser Net Shape Manufacturing (LNSM), electron beam sintering, Selective Laser Sintering (SLS), 3D printing, such as by inkjets and laserjets, Sterolithography (SLA), Electron Beam Melting (EBM), Laser Engineered Net Shaping (LENS), and Direct Metal Deposition (DMD).

The fuel nozzle 10 is connected to a fuel system 102 of a known type, operable to supply a flow of liquid fuel at varying flowrates according to operational need. In FIG. 1, the fuel system 102 is shown as a block diagram with single-line connections. In general, the fuel system 102 is functional to supply fuel to the pilot primary fuel injector 30 through a pilot primary fuel conduit 104, to the pilot secondary fuel injector 34 through a pilot secondary fuel conduit 106, to the forward main fuel gallery 54 through a forward main fuel conduit 108, and to the aft main fuel gallery 56 through an aft main fuel conduit 110.

Figure 3:
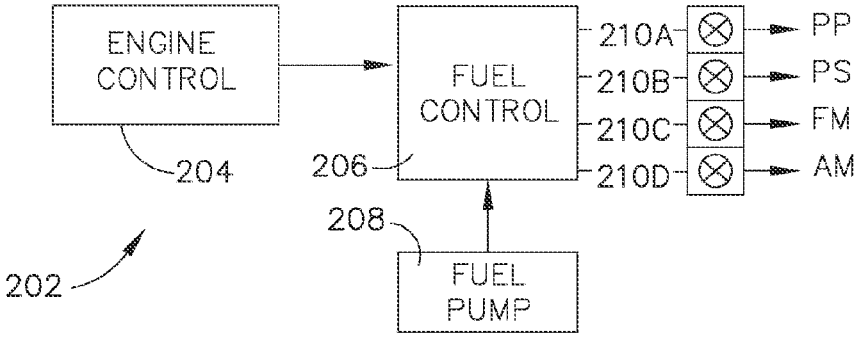
FIG. 3 is a block diagram showing a fuel system coupled to the fuel nozzle of FIG. 1.

FIG. 3 illustrates an example of a specific configuration of a fuel system 202 comprising an engine control 204, such as a hydromechanical unit or full authority digital engine control ("FADEC"). The engine control 204 is connected to a fuel control 206 which is operable to receive pressurized liquid fuel from a fuel pump 208 and, in response to commands from the engine control 204, meter fuel to individual stages of the fuel nozzle 10. In FIG. 3 the fuel control 206 is configured to provide independently-controllable fuel supplies to four fuel manifolds or flowpaths 210A, 210B, 210C, and 210D, which in turn supply the stages or circuits of the fuel nozzle PP, PS, FM, and AM as described above. It will be understood that FIG. 3 is schematic, and in practice, each manifold 210A-210D would be connected to a plurality of the fuel nozzles 10.

Figure 4:
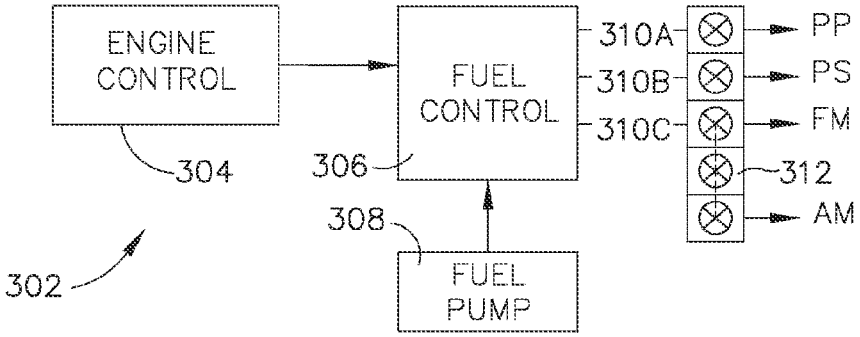
FIG. 4 is a block diagram of an alternative fuel system.

FIG. 4 illustrates an example of an alternative fuel system 302 comprising an engine control 304, fuel control 306, fuel pump 308, manifolds 310A, 310B, 310C, and fuel nozzle stages PP, PS, FM, AM. In FIG. 4 the fuel control 306 is configured to provide independently-controllable fuel supplies to three fuel manifolds or flowpaths 310A, 310B, 310C. These are directly coupled to three of the stages or circuits PP, PS, and FM, respectively. A staging valve 312 interconnects the forward main manifold 310C and the aft main stage AM. The staging valve 312 is depicted schematically in FIG. 4 and may be physically located within the fuel nozzle 10. The staging valve 312 flows fuel to the aft main stage AM in response to the prevailing flow conditions in the forward main manifold 310C, according to a predetermined physical relationship. For example, the staging valve 312 may be responsive to flow rate, absolute pressure, or a pressure differential. In its simplest form the staging valve 312 could be a spring-loaded, normally-closed valve with a linear spring rate. This configuration provides a degree of control without the complexity of a fully-independent fuel manifold.

Figure 5:
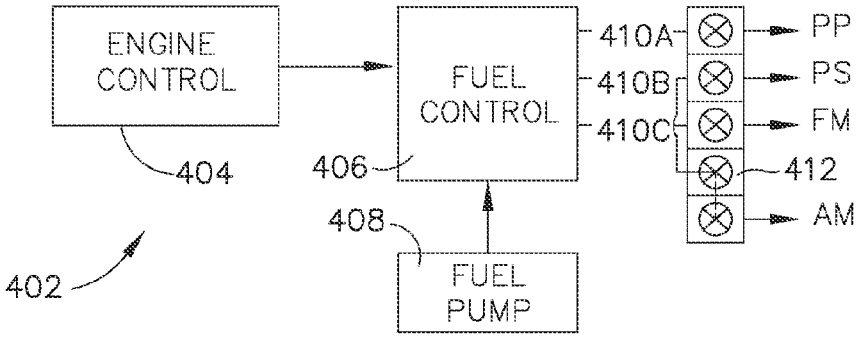
FIG. 5 is a block diagram of another alternative fuel system

FIG. 5 illustrates another example of an alternative fuel system 402 comprising an engine control 404, fuel control 406, fuel pump 408, manifolds 410A, 410B, 410C, and fuel nozzle stages PP, PS, FM, AM. In FIG. 5 the fuel control 406 is configured to provide independently-controllable fuel supplies to three fuel manifolds or flowpaths 410A, 410B, 410C. These are directly coupled to three of the stages or circuits PP, PS, and FM, respectively. A staging valve 412 interconnects the pilot secondary manifold 410B and the aft main stage AM. The staging valve 412 is depicted schematically in FIG. 5 and may be physically located within the fuel nozzle 10. The staging valve 412 flows fuel to the aft main stage AM in response to the prevailing flow conditions in the pilot secondary manifold 410B, according to a predetermined physical relationship. For example, the staging valve 412 may be responsive to flow rate, absolute pressure, or a pressure differential. In its simplest form the staging valve 412 could be a spring-loaded, normally-closed valve with a linear spring rate.

The invention described above has several benefits. The presence of two fuel circuits in the main stage provides for on-the fly capability to alter a fuel-air mixing profile, for a constant fuel split between pilot and main. This can be used for example, for real-time control during engine operation, to control dynamics in the combustor exit pressure (p4) that affect the generator of control high-frequency tones, and/or for control of high-power emissions (e.g. NOx), and/or for control of cruise specific fuel consumption ("SFC"). Lateral offset between the two rings of orifices, and/or differing numbers of orifices in the two rings, can be used to tailor the effect of the two stages for a particular application. The use of a second main stage also provides for an "overflow" circuit to reduce engine pump pressure without sacrificing a desired pilot-main fuel split.

The foregoing has described a main injection structure for a gas turbine engine fuel nozzle. All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends any novel one, or any novel combination, of the features disclosed in this specification (including any accompanying claims, abstract and drawings), or to any novel one, or any novel combination, of the steps of any method or process so disclosed.

What is claimed is:

1. A fuel nozzle apparatus for a gas turbine engine, comprising:

an annular outer body extending parallel to a centerline axis and having an exterior surface extending between forward and aft ends, and having a ring of forward openings passing through the exterior surface, and a ring of aft openings passing through the exterior surface, the ring of aft openings positioned axially aft of the ring of forward openings and circumferentially offset from the ring of forward openings;

an annular main injection ring disposed inside the annular outer body and including:

a forward main fuel gallery extending in a circumferential direction;

an aft main fuel gallery extending in the circumferential direction;

a ring of forward main fuel orifices, each forward main fuel orifice of the ring of forward main fuel orifices communicating with the forward main fuel gallery and aligned with one of the forward openings of the ring of forward openings;

a ring of aft main fuel orifices, each aft main fuel orifice of the ring of aft main fuel orifices communicating with the aft main fuel gallery and aligned with one of the aft openings of the ring of aft openings; and a pilot fuel injector disposed along the centerline axis, wherein the annular main injection ring includes an annular array of fuel posts extending radially outward from the annular main injection ring, each fuel post of the annular array of fuel posts being aligned with one of the openings of the ring of forward openings or the ring of aft openings in the annular outer body and separated from the one of the openings of the ring of forward openings or the ring of aft openings by a perimeter gap, the perimeter gap being around each fuel post of the annular array of fuel posts and permitting a purge air to flow through; and each main fuel orifice of the ring of forward main fuel orifices and the ring of aft main fuel orifices extends through one of the fuel posts of the annular array of fuel posts; and wherein each fuel post of the annular array of fuel posts is elongated in plan view and includes a perimeter wall defining a lateral surface and a radially-outward-facing floor recessed radially inward from a distal end surface of the perimeter wall to define a spray well; and wherein the perimeter gap is defined between each opening of the ring of forward openings or the ring of aft openings and each lateral surface of the annular array of fuel posts.

2. The apparatus of claim 1, wherein a concave fillet is disposed at the junction of each fuel post of the annular array of fuel posts and the annular main injection ring.

3. The apparatus of claim 1, wherein a convex-curved fillet is formed n the annular outer body adjoining each opening of the ring of forward openings and the ring of aft openings.

4. The apparatus of claim 1, wherein an assist port is formed in the perimeter wall of each fuel post of the annular array of fuel posts near an intersection of the perimeter wall of each fuel post of the annular array of fuel posts with the radially-outward facing floor of each fuel post of annular array of fuel posts.

5. The apparatus of claim 1, wherein at least one of the fuel posts of the annular array of fuel posts incorporates a ramp-shaped scarf extending along a line parallel to the distal end surface of the at least one of the fuel posts of the annular array of fuel posts, the ramp-shaped scarf having a maximum radial depth at the spray well of the at least one of the fuel posts of the annular array of fuel posts and tapering outward in radial height, joining the distal end surface of the at least one of the fuel posts of the annular array of fuel posts at a distance away from the spray well of the at least one of the fuel posts of the annular array of fuel posts.

6. The apparatus of claim 1, wherein the perimeter wall of each fuel post of the annular array of fuel posts is racetrack-shaped in plan view.

* * * * *